United States Patent [19]

Hasegawa

[11] Patent Number: 4,747,189

[45] Date of Patent: May 31, 1988

[54] SWIVEL-HEAD BUTTON

[75] Inventor: Yoshihiko Hasegawa, Kawasaki, Japan

[73] Assignee: Scovill Japan Kabushiki Kaisha, Tokyo, Japan

[21] Appl. No.: 41,173

[22] Filed: Apr. 22, 1987

[30] Foreign Application Priority Data

Jul. 29, 1986 [JP] Japan ..... 61-115301[U]

[51] Int. Cl.[4] ..... A44B 1/18

[52] U.S. Cl. ..... 24/90 R; 24/98; 24/113 R

[58] Field of Search ..... 24/90 R, 90 B, 90 E, 24/92, 94, 96, 98, 103, 104, 113 R

[56] References Cited

U.S. PATENT DOCUMENTS

| | | | |
|---|---|---|---|
| 604,882 | 5/1898 | Hall | 24/92 |
| 1,295,109 | 2/1919 | Britt | 24/90 R |
| 1,359,038 | 11/1920 | Debeaumont | 24/98 |
| 1,648,033 | 11/1927 | Thompson | 24/90 R |
| 1,944,513 | 1/1934 | Johnson | 24/90 E |
| 4,180,899 | 1/1980 | Mikosinski | 24/94 |
| 4,475,273 | 10/1984 | Konno | 24/94 |
| 4,654,934 | 4/1987 | Hasegawa | 24/113 R |

FOREIGN PATENT DOCUMENTS

| | | |
|---|---|---|
| 760978 | 11/1956 | United Kingdom . |
| 869915 | 6/1961 | United Kingdom . |

*Primary Examiner*—Victor N. Sakran

*Attorney, Agent, or Firm*—Seidel, Gonda, Goldhammer & Abbott

[57] ABSTRACT

The present invention provides a swivel-head button comprising a button member with a cylindrical member upstanding from a flange and an attaching member with an opening in the center in which said cylindrical member is received, the bottom end of said cylindrical member being provided with a fulcrum part for swivelling head movement having an outer diameter larger than the opening of said attaching member.

The swivel-head button is simple and minituarized in construction but retains a sufficient attaching strength.

4 Claims, 1 Drawing Sheet

SWIVEL-HEAD BUTTON

BACKGROUND OF THE INVENTION 1. (Field of the Invention)

This invention relates to a swivel-head button, and more precisely to a swivel-head button which is simple in structure and easy to miniaturize.

2. (Explanation of Conventional Technique)

Conventionally, a swivel-head button used with thick clothes, such as jeans, is a type as illustated in FIG. 1 which comprises an attaching member 4 consisting of a flange 1 and a hollow stud 2 protruding from the center of the flange 1 and a button member 10 comprising a back member 7 with a retaining cell 6 having in the center a loose hole 5 and an ornamental facing piece which covers the back member and is fixed thereon. These members are attached to a cloth by causing the hollow stud 2 to pierce through the cloth into the loose hole 5 of the button member 10 by way of an interposing middle flange 11 and expanding the top end of the stud in the retaining cell 6. Alternatively, another type as illustrated in FIG. 2 is used in which a tack 14 with a pointed top pierces through a cloth into a button member 13, expanded and fixed therein, which makes it easy to put on or off such a thick cloth from the button.

However, a conventional swivel-head button with such structure is complicated in structure. For example, in FIG. 1, it comprises three members such as the button member 10, the hollow stud 11 and the attaching member 4, and therefore, many processes are required before they are finally attached to the cloth. Moreover, in the foregoing conventional product, the retaining cell 6 of back member 7 of the button requires structurally a sufficient space for the swivelling head movement of the button member which is pivoted on the hollow stud 2 of the attaching member. Therefore, taking account of a balance between a hollow stud 11 which is inserted in the retaining cell and the strength of the hollow stud, there is a limit to miniaturize the button member with such retaining cell 6.

(OBJECT OF THE INVENTION)

An object of this invention is to simplify the structure of a swivel-head button in order that the swivel-head button may be miniaturized and that the processes prior to its attachment to a cloth may be reduced.

Another object of this invention is to reduce the thickness of an attaching member to the cloth.

Still another object of this invention is to provide a fulcrum part for a swivelling head movement of a swivel-head button on the side of a button member, and by this, a transmission of stress generated by the swivelling head movement to the attaching member is minimized and is obtained an attaching strength equal to or more than a conventional swivel-head button.

DETAILED DRESCRIPTION OF THE INVENTION

According to the present invention, a swivel-head button comprises a button member with a cylindrical part which is upstanding downwardly from the central part and an attaching member which has an opening in the center. In use the bottom end of the cylindrical part is inserted into the opening of the attaching member, and then curled to a certain degree to provide a fulcrum part 21 for the swivelling head movement of swivel-head button.

With the foregoing structure, the present swivel-head button is simple in structure and makes it easy to produce and attach to a cloth. In addition, as the attaching member can be an eyelet member, the height of the attaching member attached to the surface of the cloth, that is the axial thickness, can be thin, also as the fulcrum part for the swivelling head movement is provided at the end of the cylindrical part of the button member, the stress generated by the swivelling head movement is transmitted by the fulcrum mainly to the back of the attaching member, and therefore, the attaching strength to the cloth can not be ruined.

Figure 1:
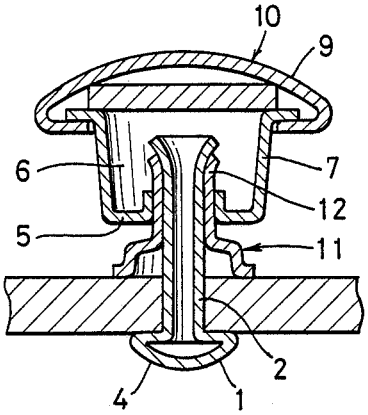
Fig. 1 Prior Art
FIG. 1 is a cross-sectional view of a conventional swivel-head button.
Figure 2:
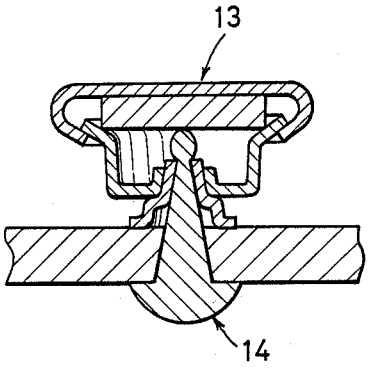
Fig. 2 Prior Art
FIG. 2 is a cross-sectional view of another swivel-head button of the prior art.
Figure 3:
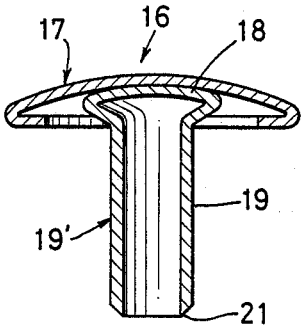
FIG. 3 is a cross-sectional view of the button member of the present invention.
Figure 4:
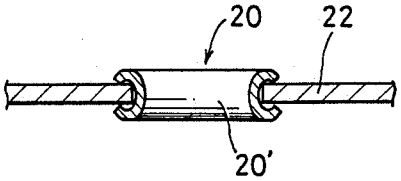
FIG. 4 is a cross-sectional view of the attaching member of the invention.

The present invention will be hereinafter explained in detail by making reference to the drawings. FIG. 3 illustrates a button member 16 used in the present invention. The button member preferably comprises an eyelet 19' consisting of a base flange 18 and a cylindrical member 19 which is upstanding from the center thereof and a cap 17 which is attached to and covers the base flange 18 of the eyelet 19'. On the other hand, the attaching member, as shown by numeral 20 in FIG. 4, preferably has a shape like an eyelet member and has an opening 20' in the central part when a cloth is attached thereto.

Figure 5:
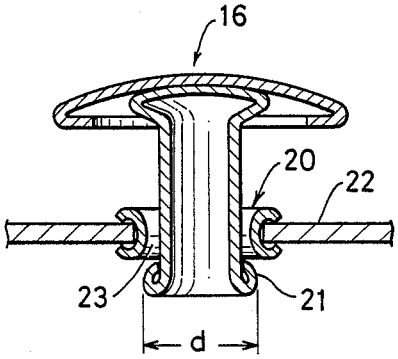
FIG. 5 is a cross-sectional view showing the swivel-head button attached to the cloth according to the invention.

Referring now to FIG. 5, in assembling the swivel-head button, the attaching member 20 is first attached to the cloth, and then the cylindrical part 19 of the button member 16 is inserted into the opening 20'. The bottom end 21 of the cylindrical part 19 is curl-treated under pressure preferably to form a ball or bead as illustrated in such manner that the outside diameter d of the curled part becomes larger than the inner diameter of the opening 20'. By making the bottom end of cylindrical member 19 into said form, the curl-treated part 21 is attached to the back side 23 of the attaching member when the button 16 is pulled upwards or when it makes the swivel-head movement and thus a fulcrum is formed at this part.

Although a detailed explanation was made based on a preferred embodiment, it should be noted that many modifications are possible within the scope of the present invention.

What is claimed is:

1. A swivel-head button comprising a button member with a cylindrical member upstanding from a flange and an attaching member with an opening in the center in which said cylindrical member is received, the bottom end of said cylindrical member being provided with a fulcrum part for swivelling head movement having an outer diameter larger than the opening of said attaching member.

2. A swivel-head button according to claim 1 in which the button member comprises an eyelet consistingh of a base flange and said cylindrical member upstanding from the center of said base flange, and a cap covering said base flange of said eyelet.

3. A swivel-head button according to claim 1 in which the fulcrum part for the swivelling head movement is formed by curl-treatment in such manner that the outer diameter of said fulcrum part is larger than the inner diameter of the opening of the attaching member.

4. Swivel head button comprising a button member having a flanged portion, an end portion and a generally cylindrical portion connecting said flanged and end portion, an attaching member having an opening adapted to receive said button member cylindrical portion, said end portion and at least a portion of said attaching member being formed so as to prevent withdrawal of said button member from said attaching member and so as to produce swiveling motion of said button member in contact with said attaching member.

* * * * *